US005335942A

United States Patent [19]

Grinfas et al.

[11] Patent Number: 5,335,942

[45] Date of Patent: Aug. 9, 1994

[54] STYLUS FOR AN ERASABLE MARKER SYSTEM

[75] Inventors: Zvi Grinfas; Georges Weil; Maurice Miller, all of Herzliya Pituach, Israel

[73] Assignee: System RM Ltd., Douglas, Isle of Man

[21] Appl. No.: 990,951

[22] Filed: Dec. 17, 1992

[51] Int. Cl.[5] ..... B42D 15/00

[52] U.S. Cl. ..... 283/74; 434/410

[58] Field of Search ..... 434/410; 74/1 R; 283/74, 70, 67, 45

[56] References Cited

U.S. PATENT DOCUMENTS

| | | | |
|---|---|---|---|
| 1,881,140 | 10/1932 | Settel . | |
| 2,894,336 | 7/1959 | Thorner | 434/410 |
| 3,579,871 | 5/1971 | Eddington | 434/410 |
| 4,011,665 | 3/1977 | Port . | |
| 4,589,685 | 5/1986 | Lazar . | |
| 4,763,929 | 8/1988 | Weil | 434/410 X |

FOREIGN PATENT DOCUMENTS

| | | |
|---|---|---|
| 71085 | 10/1893 | Fed. Rep. of Germany . |
| 782518 | 9/1957 | United Kingdom . |
| 967410 | 8/1964 | United Kingdom . |
| 1389438 | 3/1975 | United Kingdom . |
| 2055702 | 3/1981 | United Kingdom . |
| 2118135 | 10/1983 | United Kingdom . |
| 2132979 | 7/1984 | United Kingdom . |
| 8904771 | 6/1989 | World Int. Prop. O. . |
| 92-22901 | 12/1992 | World Int. Prop. O. . |
| 9222434 | 12/1992 | World Int. Prop. O. . |

*Primary Examiner*—Mark Rosenbaum
*Assistant Examiner*—Willmon Fridie, Jr.
*Attorney, Agent, or Firm*—Wegner, Cantor, Mueller & Player

[57] ABSTRACT

A stylus for marking an arrangement of the type in which a first foil layer can be releasably attached to a second layer at any desired point, points of attachment therebetween being visually distinctive and constituting indicia, including a shaft having a blunt point at one end and engagement structure disposed transversely with respect to the axis of said shaft, the engagement structure being adapted to co-operate with a cursor mounted over the first layer to convey the cursor in contact with the engagement means along the first layer.

16 Claims, 2 Drawing Sheets

STYLUS FOR AN ERASABLE MARKER SYSTEM

This invention relates to a stylus for an erasable marker system, which system is more particularly, but not exclusively, adapted for use on or in connection with video cassettes.

With the current popularity of home video recording, largely for the time-shifting of television broadcasts, it is common for a given video cassette to be used to record one particular programme and, after that programme has been viewed, for the same cassette to be re-used to record another programme. This presents problems for those who wish to store their video cassettes with an easily readable record of the programme material recorded on each cassette. There thus exists a need for a marker system usable with video cassettes which can readily be erased and re-written when a video cassette is re-used.

U.S. Pat. No. 4,763,929 (published Aug. 16 1988) discloses an erasable device for video or other cassettes which comprises an elongate housing which may be attached to the back (spine) of a cassette by means of a pressure sensitive adhesive. The label housing has on one face a window through which a foil arrangement is visible. The foil arrangement comprises an acetate foil, a transparent paper or strip underneath the acetate foil and a lowermost wax foil. The transparent paper is releasably stuck or bound to the wax foil under the writing pressure exerted upon the acetate foil. To erase the writing it is necessary to separate the transparent paper and the wax foil. For this purpose, a cursor is provided in the device which has a lower member intermediate the paper and wax foil and an upper member movable within the window of the label housing. A particular feature described in this patent specification is the cursor which is described as being finger-operable.

A problem with the device described and illustrated in U.S. Pat. No. 4,763,929 is that, because the cursor is provided as being finger-operable, it is relatively easy to slide it within the device. Consequently, unwanted movement of the cursor within the device is liable to occur, thereby erasing indicia marked on the device. Moreover, the patent does not contemplate the use of a specific tool for generating local pressure to cause the transparent paper to become releasably stuck to the wax foil. Instead, the tip of a ball-point pen may be used for this purpose. A pen, however, is likely to mark the outer surface of the marker device, and such markings are not erased by routine operation of the cursor.

It is an object of the present invention to provide a stylus for an erasable marker system and an erasable marker system including a stylus which alleviate the problems of the prior art.

According to one aspect of the present invention, there is provided a stylus for marking an arrangement of the type in which a first foil layer can be releasably attached to a second layer at any desired point, points of attachment therebetween being visually distinctive and constituting indicia, wherein said stylus comprises a shaft having a blunt point at one end thereof and a having engagement means disposed transversely with respect to the axis of said shaft, the arrangement being such that said engagement means can, in use, co-operate with a cursor mounted over said first layer to convey said cursor along said first layer.

Preferably, the engagement means comprises a linear edge portion, the arrangement being such that said edge is able to engage the cursor.

In one embodiment, the engagement means may comprise a projection extending from the shaft or from a recessed area along the shaft, the projection having one or more transverse edge members arranged so as to be able to convey the cursor along the first layer. The projection may have a single, linear transverse edge member or may have two or more transverse edge members arranged in a generally linear array.

Preferably, the projection includes a first surface which extends transversely with respect to the axis of the shaft and a second surface which is angled to slope in the direction away from the blunt point. The projection may be located at the opposite end of the shaft to the blunt point.

The invention also provides a marker system comprising:

a) a stylus as described hereinabove; and b) a marker device suitable for attachment to a video cassette or the like, which marker device comprises:

i) a laminar frame member having an elongate aperture therein, ii) an adhesive layer having one side secured to said frame member and the other side adapted to be secured to a surface of, for example, a video cassette, iii) an arrangement of the type in which a first foil layer can be releasably attached to a second layer at any desired point, points of attachment therebetween being visually distinctive and constituting indicia, said arrangement being located between said frame member and said adhesive layer to form a display portion in the aperture, and iv) a cursor, slidable between opposite ends of said aperture, and comprising a top portion received in said aperture and a bottom portion located between said first and second layers so as to be able to release said points of attachment and thereby erase said indicia, wherein said engagement means can, in use, cooperate with said top portion of said cursor to convey said cursor along said first layer.

The frame member may have stop members formed at opposite ends of the aperture adapted to engage the bottom portion of the cursor to limit sliding of the cursor.

The cursor may be arranged so that, when the bottom portion engages a stop member, a gap exists between the top portion of the cursor and the end of the aperture, the arrangement being such that the gap can accommodate the engaging means to permit engagement with the cursor. In one embodiment, the cursor has one or more recesses, the arrangement being such that the recesses can accommodate the engaging means to permit engagement with the cursor.

While the invention will be described hereinafter with reference to its use in conjunction with video cassettes, it is to be understood that the invention is not limited to application with video cassettes. The marker system of the invention may be used in conjunction with any of the following: audio tapes, filing systems (e.g. on a paper file, on a filing cabinet or on a desk drawer), telephones and other communication media (e.g. as a note pad or personal organiser), retail goods (e.g. to convey information to the consumer), photography (e.g. attached to a camera case or strap and facilitating the noting down of exposure details), menus (e.g. to indicate the dish of the day), computers (e.g. on or near a keyboard or visual display unit), brief cases and luggage, and display boards (e.g. in offices, hotels, factories and schools). Where the marker device of the system of the invention is used in a display of large area, the overall display may comprise a plurality of smaller individual units constructed in accordance with this invention and disposed in the desired manner. When used with video cassettes, the marker device will generally be elongate in form; for other applications, e.g. as an erasable luggage label, different formats may be used, for example of credit card size.

Preferably, the two strips have above them a tough, transparent protective strip formed, for example, of an acetate (e.g. "Cellophane"—Registered Trade Mark) or of polyethylene terephthalate or other polyester material.

In the system of present invention, the generation of local pressure by the blunt point of the stylus causes the first layer (e.g. a transparent paper strip) to adhere to the second layer, which will generally be a dark wax surface, thus altering the visual appearance of the device at the point where pressure was applied. It is thus possible to write indicia on the device to give an indication of the programme material contained on a given cassette.

The cursor is preferably arranged such that it is received sufficiently tightly in the device to prevent it being moved by means of finger pressure alone. Accordingly, unwanted movement of the cursor, and consequent accidental erasure of indicia, can be prevented.

When the programme material is erased and the cassette is re-recorded, the engaging means of the stylus is used to engage the cursor and the stylus is used to convey the cursor along the length of the device, thus separating the first and second layers and erasing the indicia carried by the device.

For a better understanding of the invention, and to show how the same may be carried into effect, reference will now be made, by way of example, to the accompanying drawings, in which.

Figure 1:
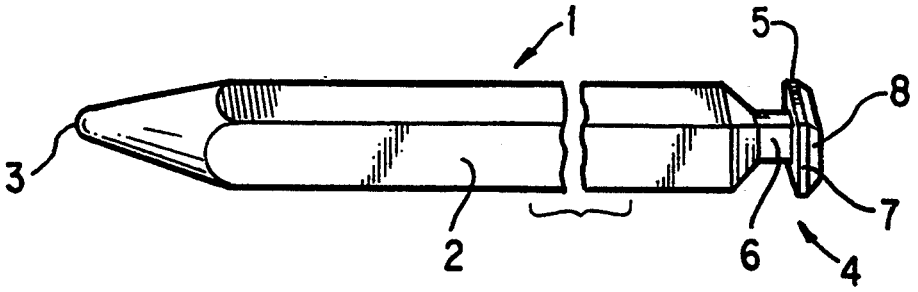
FIG. 1 is a perspective view of a of a stylus in accordance with the invention.

Referring to the drawings, the stylus 1 comprises a shaft 2 which is square in cross-section. Shaft 2 has a blunt point 3 at one end and engagement means indicated generally by the numeral 4 at the other end.

In the embodiment illustrated in FIG. 1, engagement means 4 is formed by a flange 5 which extends from a recessed portion 6 of shaft 2. Flange 5 extends to the same width as the remainder of shaft 2 and has four faces. Each face includes a linear edge 7, which is transverse with respect to the axis of shaft 2, and a bevel 8 which slopes towards the end of shaft 2.

Figure 2:
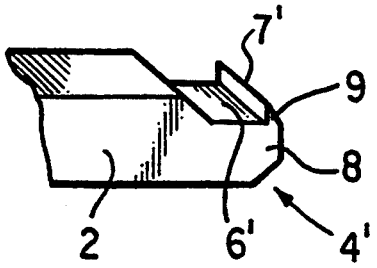
FIG. 2 is a partial perspective view of an alternative form of engaging means of the stylus of FIG. 1.

An alternative embodiment is illustrated in FIG. 2, in which engagement means 4' is formed by a projection 9 extending from a recessed portion 6' on one face of shaft 2. Projection 9 includes a linear edge 7''. The end of shaft 2 is bevelled in a similar manner to the embodiment illustrated in FIG. 1.

Figure 3:
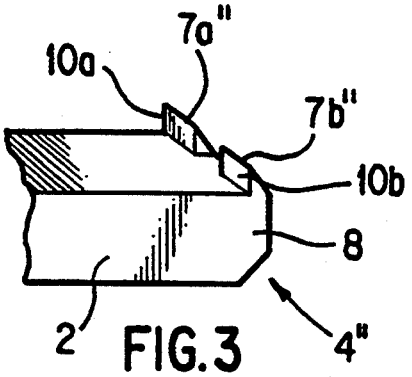
FIG. 3 is a partial perspective view of another alternative form of engaging means of the stylus of FIG. 1.

A further alternative embodiment is illustrated in FIG. 3. In this embodiment, engagement means 4'' is formed by two projections 10*a*, 10*b* extending from shaft 2. Projections 10*a*, 10*b* have respective linear edges 7*a*'', 7*b*''. The end of shaft 2 is bevelled in a similar manner to the embodiment illustrated in FIG. 1.

It will be appreciated from the foregoing description of stylus 1 that the engagement means can be provided in a variety of forms. In this respect, engagement means can be arranged to project from a plurality, or just one, of the faces of shaft 2. Also engagement means can project from the shaft to extend beyond the shaft or can project from a recessed portion of the shaft. Moreover, only one, or a plurality of projections can be provided.

Figure 4:
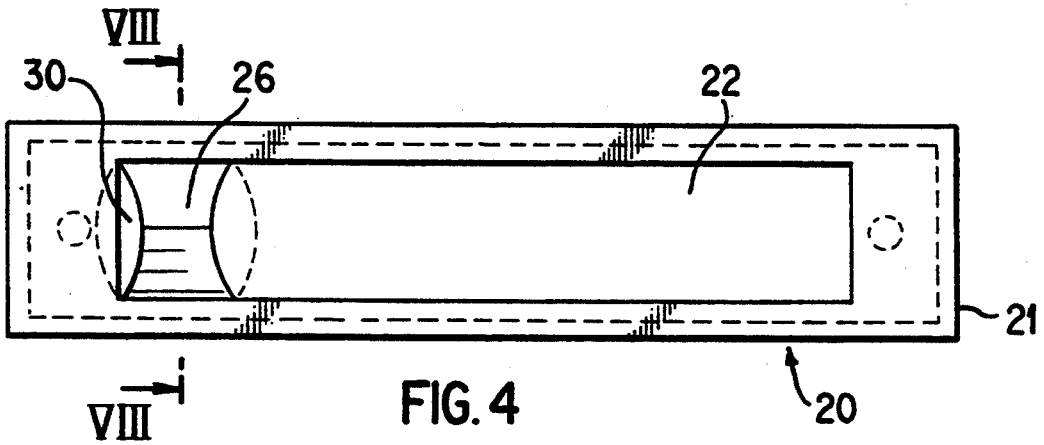
FIG. 4 is a plan view of a marker device in accordance with the invention.
Figure 5:
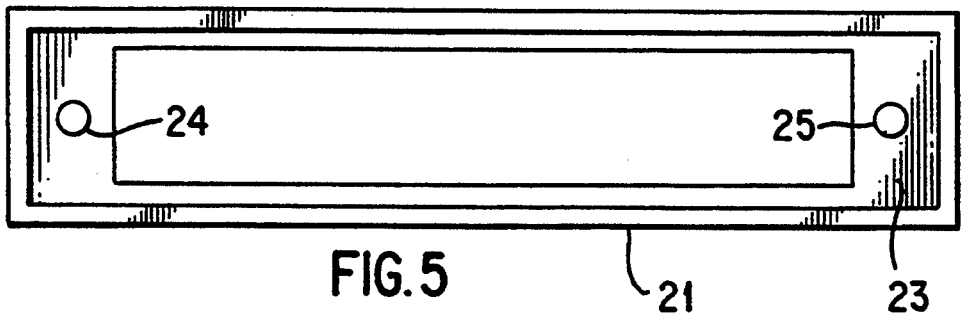
FIG. 5 is an plan view of the lower surface of the frame member of the device of FIG. 4.

Referring now to FIG. 4, a marking device 20 comprises a moulded plastics frame 21 having a large aperture or window 22 therein. As shown in FIG. 5, the lower surface of frame 21 has a recess 23 surrounding window 22 and stop members 24, 25 projecting from recess 23 at respective ends of window 22. A cursor 26 is received in recess 23 to slide between stop members 24, 25. It is to be noted that cursor 26 is sufficiently tightly received in recess 23 to prevent it being moved by means of finger pressure alone.

Figure 8:
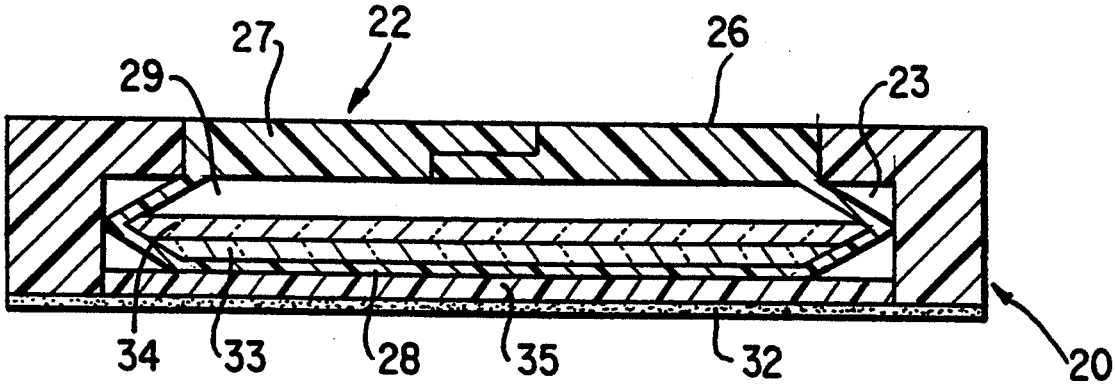
FIG. 8 is an enlarged schematic sectional view along the lines VIII—VIII of FIG. 4.
Figure 6:
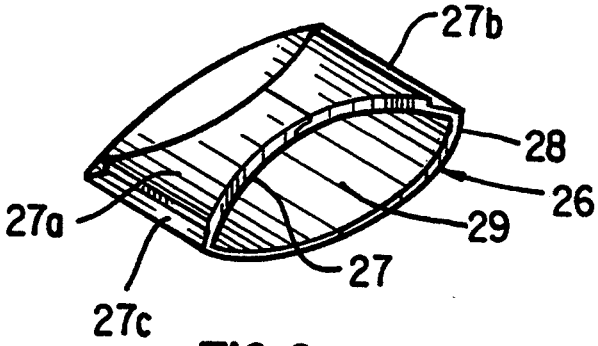
FIG. 6 is a perspective view of the cursor of the device of FIG. 4.
Figure 7:
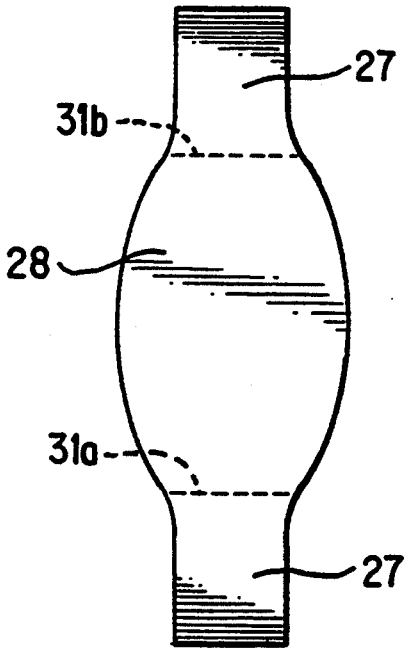
FIG. 7 is a plan view of the cursor of FIG. 6 in unassembled form.

Cursor 26 is illustrated in more detail in FIG. 6, where it will be seen that cursor 26 is in the form of an envelope which has upper and lower members 27 and 28, respectively, which define an aperture 29. Over most of the cursor 26, lower member 28 has a width greater than that of upper member 27, which enables a gap 30 to be formed between upper member 27 and frame 21 when lower member 28 abuts either of stop members 24, 25 (FIG. 4). The portion 27*a* of upper member 27 which is to be received in window 22 has a greater thickness than the remaining portions 27*b*, 27*c* of upper member 27 that are to be received in recess 23, so that portion 27*a* lies substantially flush with the upper surface of frame member 21 (FIG. 8). As shown in FIG. 7, cursor 26 constructed from a single piece of, for example plastics material. Upper member 27 comprises two parts which are folded about fold lines 31*a*, 31*b* and joined at their respective ends to form cursor 26.

Referring to FIG. 8, an adhesive layer 32, which may be covered by a peel-off protective strip, is provided on the lower surface of frame 21. Adhesive layer 32 may comprise a pressure-sensitive adhesive. A first foil layer in the form of an elongate strip or foil 33 formed of a transparent paper material is housed within frame 21 so as to pass through aperture 29 of the cursor 26. Overlying the first foil layer 33 is a further elongate strip 34 which is a transparent acetate or Mylar (Registered Trade Mark) foil.

Adhesive layer 32 within frame 21 carries a second layer 35 which is a wax layer. The paper foil 33 cooperates with wax layer 35 to define a display zone within which indicia may be generated. Application of localised pressure by means of the blunt point 3 of stylus 1 at any desired point within the display zone causes the paper foil 33 to adhere to the surface of wax layer 35 at such points. These points represent image elements or indicia and are visually discernible from the remainder of the display zone where there is no adherence between paper foil 33 and wax layer 35.

In use, device 20 is attached to the spine of a video cassette by means of adhesive layer 32. Blunt point 3 of stylus 1 is used to apply localised pressure within the display zone to generate indicia, as mentioned above. Such indicia may, for example, indicate the material recorded on the video cassette. Cursor 26 is generally located adjacent the end of widow 22 (as shown in FIG. 4) to provide the maximum area in which indicia can be generated.

If an image element is to be erased, engaging means 4 of the stylus 1 is engaged with the upper member 27 of cursor 26, with the linear edge 7 being received in gap 30. The stylus 1 can then be used to pull the cursor 26 over the region of the image element. As the cursor 26 traverses the window, the lower bar 28 of the cursor 26 lifts paper foil 33 away from the wax surface layer 35, thus eliminating the points of contact which produce the visible image.

When lower member 28 of cursor 26 abuts one of the stop members 24, 25, cursor 26 is prevented from being conveyed any further by the stylus 1. In this configuration, gap 30 exists between upper member 27 and frame 1 to receive a linear edge 7 of the stylus when indicia in the device are next to be erased.

Figure 9:
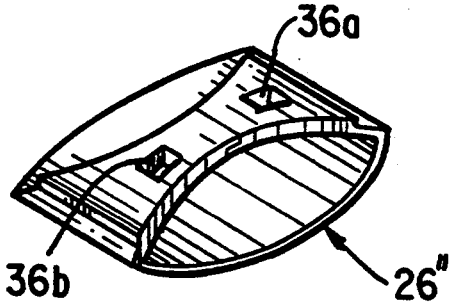
FIG. 9 is a perspective view of an alternative form of cursor of FIG. 6.

In another embodiment (see FIG. 9), the cursor 26" has recesses 36*a*, 36*b* which are adapted to accommodate projections 10*a*, 10*b* of the engagement means 4". In use, the projections 10*a*, 10*b* of the stylus engage the recesses 36*a*, 36*b* so that the cursor 26 can be conveyed by means of the stylus 1. In this embodiment, there is no necessity for there to be a gap 30 between upper member 27 and the end of window 22.

It is to be noted that the bevelled surfaces of the engaging means 4 prevent the cursor 26 from being pushed by the stylus 1. Bevels 8 cause the stylus to slide relative to the cursor 26 so that a sufficient pushing force to move the cursor 26 cannot be applied. In this way the stylus 1 can only be used to pull the cursor across the device 20. This has the advantage that such pulling causes the stylus 1 and upper member 27 to be lifted away from the layers 33, 34, 35 and therefore the stylus 1 and upper member 27 will not mark the device 20. Conversely, if the cursor 26 is pushed over the device 20, unwanted marking may occur.

Although described above as a separate device intended for attachment to the spine of a video cassette, it will be appreciated that the device 20 may be formed integrally with the cassette itself. The device, in these circumstances, will have the same features as just described except that there will be no need for the adhesive layer 32.

Conveniently, a device 20 such as that shown in the drawings (for use with a video cassette) can be about 14.4 cm (5⅝inches) long, 2 cm (¾ inch) wide and 0.1 cm (1/16 inch) thick, and the cursor 2 can conveniently be about 1.3 cm (½ inch) wide.

It will also be appreciated that a device in accordance with invention may be used to display information other than that associated with the programme material recorded on a video cassette and may be attached to objects other than video cassettes, as described hereinbefore.

We claim:

1. A stylus for marking an arrangement of the type in which a first foil layer can be releasably attached to a second layer at any desired point, points of attachment therebetween being visually distinctive and constituting indicia, wherein said stylus comprises a shaft having a blunt point at one end thereof and having engagement means disposed transversely with respect to the axis of said shaft, said engagement means being adapted to co-operate with a cursor mounted over said first foil layer to convey said cursor in contact with said engagement means along said first foil layer.

2. A stylus as claimed in claim 1, wherein said engagement means comprises a linear edge portion arranged so as to be able to engage said cursor.

3. A stylus as claimed in claim 1, wherein said engagement means comprises a projection extending from the shaft or from a recessed area along the shaft, said projection having one or more transverse edge members arranged so as to be able to convey said cursor along said first layer.

4. A stylus as claimed in claim 3, wherein said projection has a single, linear transverse edge member.

5. A stylus as claimed in claim 3, wherein said projection has two or more transverse edge members arranged in a generally linear array.

6. A stylus as claimed in claim 3, wherein said projection includes a first surface which extends transversely with respect to the axis of the shaft and a second surface which is angled to slope in the direction away from the blunt point.

7. A stylus as claimed in claim 3, wherein said projection is located at the opposite end of the shaft to said blunt point.

8. A stylus as claimed in claim 1, wherein said engagement means comprises a linear edge portion arranged so as to be able to engage said cursor and a projection extending from a recessed area of the shaft such that said linear edge portion is substantially flush with the shaft, said projection having one or more transverse edge members arranged so as to be able to convey said cursor along said first foil layer.

9. A stylus as claimed in claim 8, wherein said projection is in the form of a bevelled annular flange extending from a recessed area along said shaft.

10. A marker system comprising:

a) a stylus comprising a shaft having a blunt point at one end thereof and having engagement means disposed transversely with respect to the axis of said shaft; and b) a marker device adapted to be attached to a video cassette or the like, which marker device comprises:

i) a laminar frame member having an elongate aperture therein, ii) an adhesive layer having one side secured to said frame member and the other side adapted to be secured to a surface of, for example, a video cassette, iii) an arrangement of the type in which a first foil layer can be releasably attached to a second layer at any desired point, points of attachment therebetween being visually distinctive and constituting said indicia, said arrangement being located between said frame member and said adhesive layer to form a display portion in the aperture, and iv) a cursor, slidable between opposite ends of said aperture, and comprising a top portion received in said aperture and a bottom portion located between said first foil layer and said second layer so as to be able to release said points of attachment and thereby erase said indicia, wherein said engagement means can, in use, cooperate with said top portion of said cursor to convey said cursor along said first foil layer.

11. A marker system as claimed in claim 10, wherein said frame member has stop members formed at opposite ends of said aperture adapted to engage said bottom portion of said cursor to limit sliding of said cursor.

12. A marker system as claimed in claim 11, wherein said cursor is arranged so that, when the bottom portion engages a stop member, a gap exists between the top portion of the cursor and the end of the aperture for accommodating the engagement means to permit engagement with the cursor.

13. A marker system as claimed in claim 10, wherein said cursor has one or more recesses adapted to accommodate the engagement means to permit engagement with the cursor.

14. A marker system as claimed in claim 10, wherein said first layer comprises a transparent paper foil; and said second layer comprises a wax foil or a wax layer.

15. A marker system as claimed in claim 10, wherein said first layer has above it a tough, transparent protective strip.

16. A stylus for marking an arrangement of the type in which a first foil layer can be releasably attached to a second layer at any desired point, points of attachment therebetween being visually distinctive and constituting indicia, wherein said stylus comprises a shaft having (a) a blunt point at one end thereof and (b) engagement means comprising (i) a projection which extends from the shaft or from a recessed area along the shaft and includes a first surface, said first surface extending transversely with respect to the axis of the shaft and being adapted to co-operate with a cursor mounted over said first foil layer to convey said cursor in contact with said first surface along said first foil layer, and (ii) a second surface which is angled to slope in the direction away from the blunt point.

* * * * *